US007857632B2

(12) United States Patent
Liu et al.

(10) Patent No.: US 7,857,632 B2
(45) Date of Patent: Dec. 28, 2010

(54) POWER CONNECTOR

(75) Inventors: Jia-Hau Liu, Tu-cheng (TW); Fang-Jwu Liao, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 59 days.

(21) Appl. No.: 12/386,624

(22) Filed: Apr. 21, 2009

(65) Prior Publication Data

US 2009/0263985 A1 Oct. 22, 2009

(30) Foreign Application Priority Data

Apr. 21, 2008 (CN) ..... 2008 2 0034877 U

(51) Int. Cl.
*H01R 12/00* (2006.01)

(52) U.S. Cl. ..... 439/66

(58) Field of Classification Search ..... 439/66, 439/67, 71, 81, 342, 862; 361/785, 761
See application file for complete search history.

(56) References Cited

U.S. PATENT DOCUMENTS 5,152,695 A * 10/1992 Grabbe et al. ..... 439/71
5,655,913 A * 8/1997 Castaneda et al. ..... 439/66
6,695,624 B1 * 2/2004 Szu ..... 439/66
7,427,203 B2 * 9/2008 Liao ..... 439/66
7,563,105 B2 * 7/2009 Liu et al. ..... 439/66
7,575,440 B1 * 8/2009 Polnyi ..... 439/71
2002/0081870 A1 * 6/2002 Toda ..... 439/66
2008/0003843 A1 * 1/2008 Ruttan et al. ..... 439/66

* cited by examiner

*Primary Examiner*—Alexander Gilman
(74) *Attorney, Agent, or Firm*—Andrew C. Cheng; Wei Te Chung; Ming Chieh Chang

(57) ABSTRACT

The electrical connector has an insulative housing and a number of contacts embedded in the housing and distributed in rows and columns. Each of the contact has a pair of contacting arms with a contacting portion thereon for electrically connecting with a pad of the electronic package. The contacting portions of the contacts are arranged in a pattern of contact portions of two adjacent contacts in same row can engage with a same pad on the electronic package when the electrical connector is coupled with the electronic package, such that the contacts of the row are coupled with each other in series. By way above mentioned, pitch between two adjacent contacts can be reduced and a high density of the contacts can be achieved.

17 Claims, 11 Drawing Sheets

POWER CONNECTOR

BACKGROUND OF THE INVENTION

1. Field of the Invention

The present invention relates to a power connector, and more particularly, to a power connector having a plurality of contact terminals each having dual-contact engaging portions. The contact engaging portion is arranged such that a single conductive pad of a chip set interconnected by a pair of contact engaging portions from two adjacent contact terminals.

2. Description of Prior Art

With the development of society, people have a higher need for capability of the microprocessor. Accordingly, electrical connector for connecting the microprocessor and the motherboard is requested to have a better performance. Additionally, to suit the industry trend of miniaturization of electric device, the electrical connector is also requested to comply with a trend of miniaturization and multiple contact points.

U.S. Pat. No. 7,167,379 issued to Dibene, II on Apr. 30, 2003 discloses an electrical connector relating to the present invention. The electrical connector includes a plurality of spring conductors mounted in a carrier. Selected spring conductors in a same row are coupled with each other. Dibene, II wants to provide a small form factor, which reduces cost and volumetric spade in high performance electrical system. However, Dibene, II needs manufacturer having a high performance machine for mounting the conductors to the connector. Moreover, space between adjacent spring conductors is large so that a maximum quantity of conductors is hardly to achieve.

In view of the above, an improved electrical connector that overcomes the above-mentioned disadvantages is desired.

SUMMARY OF THE INVENTION

Accordingly, an object of the present invention is to provide an electrical connector for electrically connecting an electronic package such as a microprocessor with a circuit substrate such as a printed circuit board (PCB), which can provide a large array pattern or group of arrays of the contacts.

To achieve the above-mentioned object, an electrical connector in accordance with a preferred embodiment of the present invention for electrically connecting an electronic package with a PCB is provided. The electrical connector comprises an insulative housing, a number of contacts embedded in the housing and distributed in rows and columns. Each of the contact has a pair of contacting armseach having a contacting portion thereon for electrically connecting with a pad of the electronic package. The contacting portions of the contacts are arranged in a pattern of contact portions of two adjacent contacts in same row can engage with a same pad on the electronic package such that the contacts in the same row are coupled with each other in series. By way above mentioned, pitch between two adjacent contacts is reduced and a high density of the contacts can be achieved.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
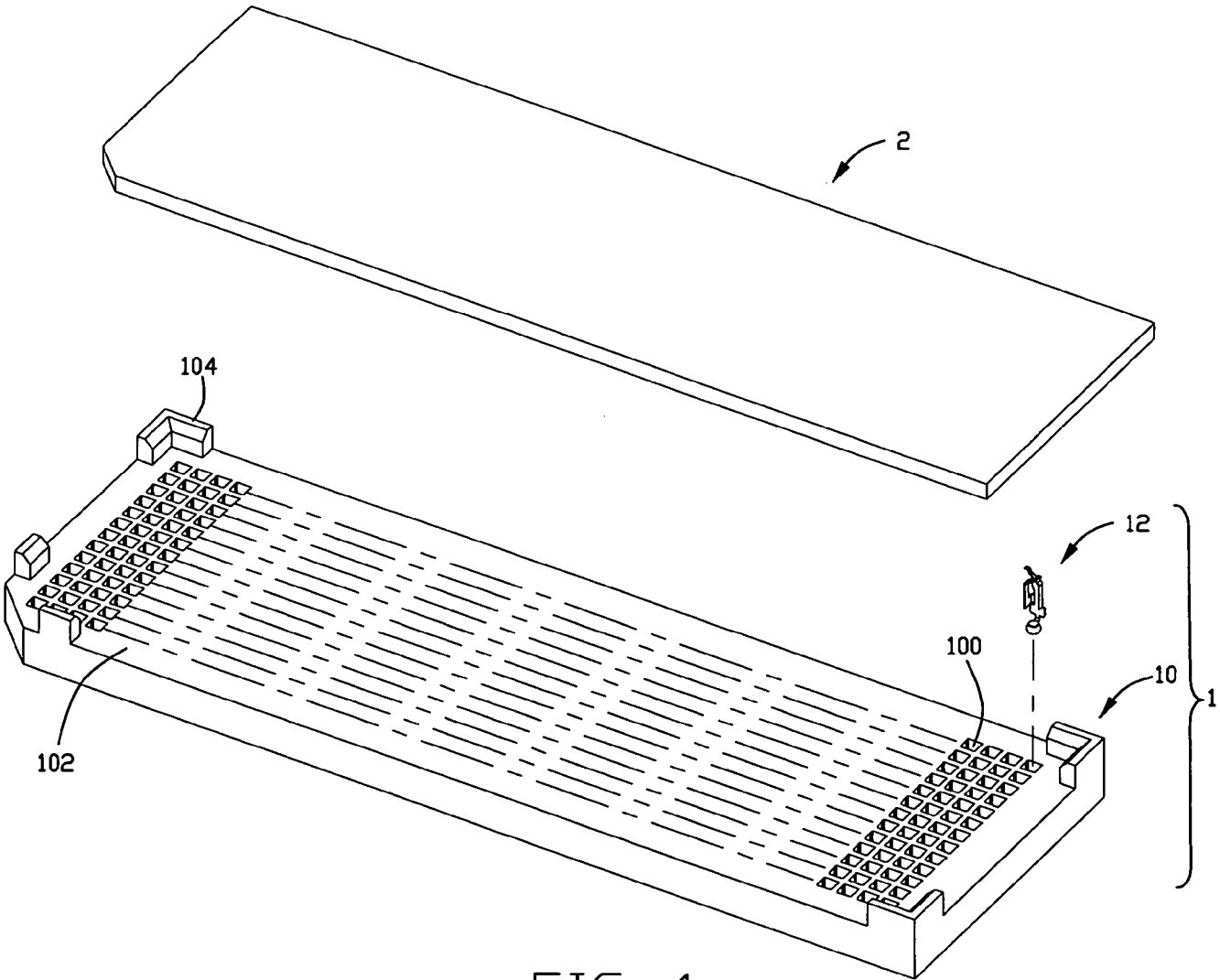
FIG. 1 is an exploded, isometric view of an electrical connector in accordance with a preferred embodiment of the present invention.
Figure 2:
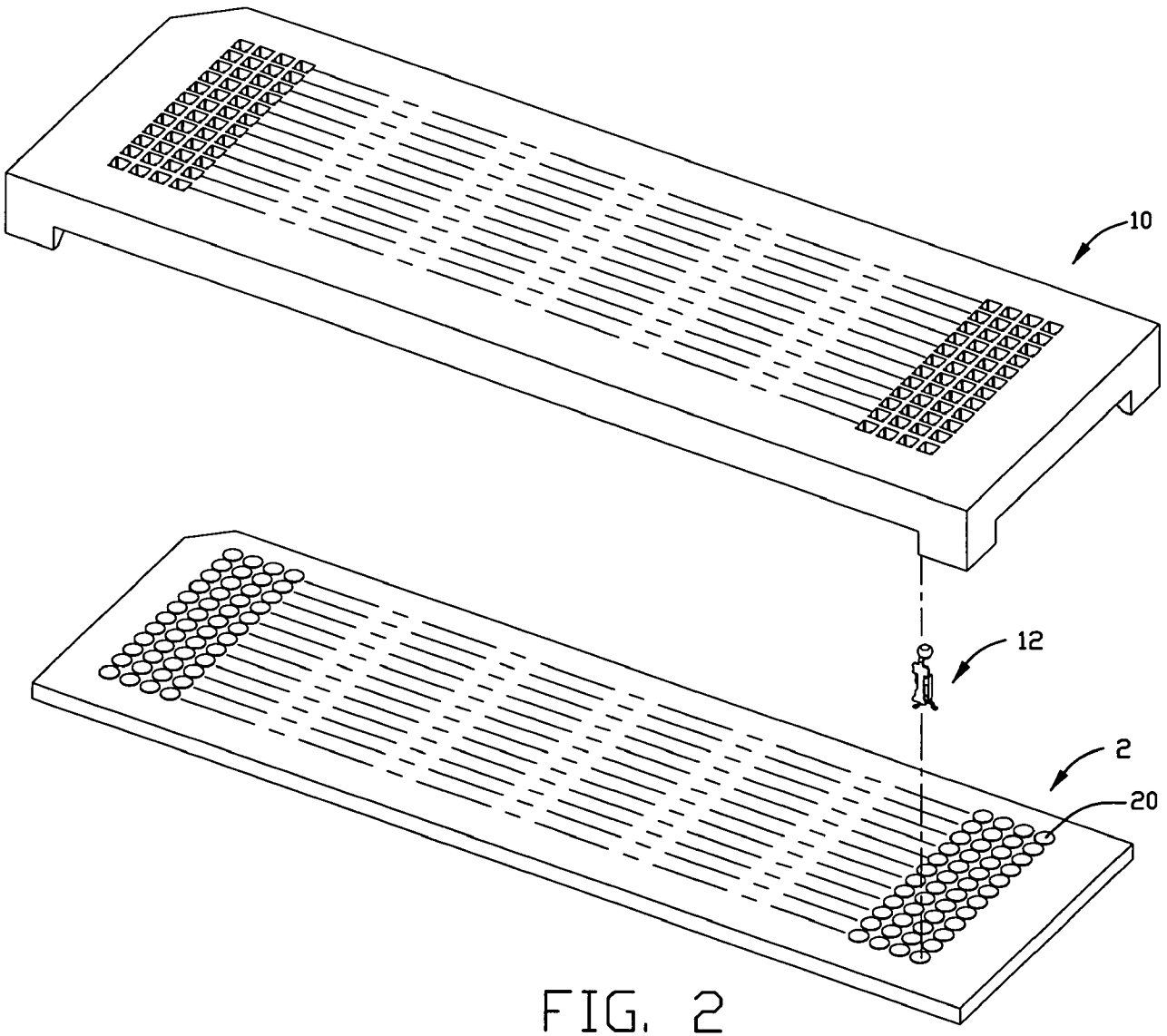
FIG. 2 is similar to FIG. 1, but from another view.

Referring to FIGS. 1-2, an electrical connector 1 in accordance with the preferred embodiment of the present invention is used for electrically connecting an electrical package 2 with a circuit substrate (not shown). The connector 1 comprises an insulative housing 10 and a plurality of electrical contacts 12 received in the housing 10.

The insulative housing 10 comprises a mating surface 102 adapted to have the electrical package 2 seated thereon. A plurality of "L" shaped protrusions 104 is formed on corners of the mating surface 102 of the housing 10, which is used for positioning the electrical package 2. A plurality of passageways 100 is distributed in rows and columns on the mating surface 102 for receiving corresponding contacts 12, respectively.

Figure 3:
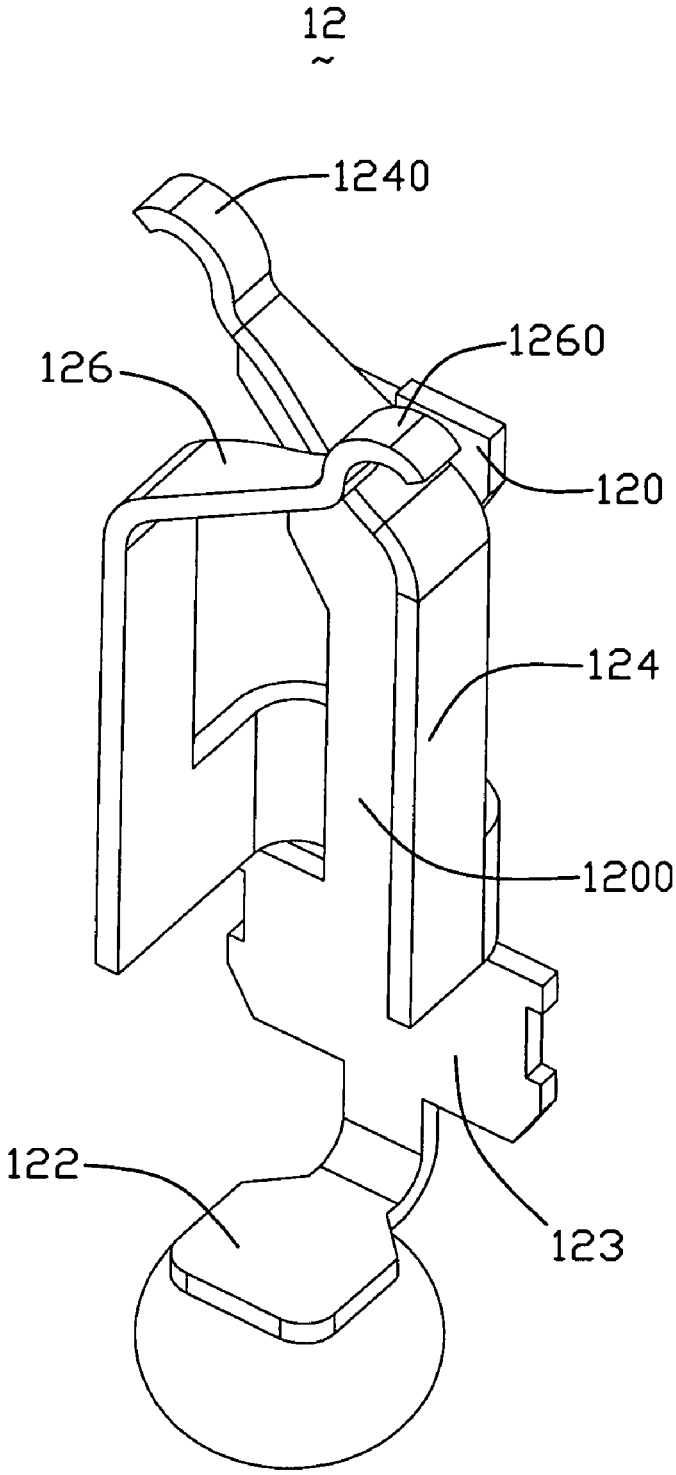
FIG. 3 is perspective view of the electrical contact of the present invention.
Figure 4:
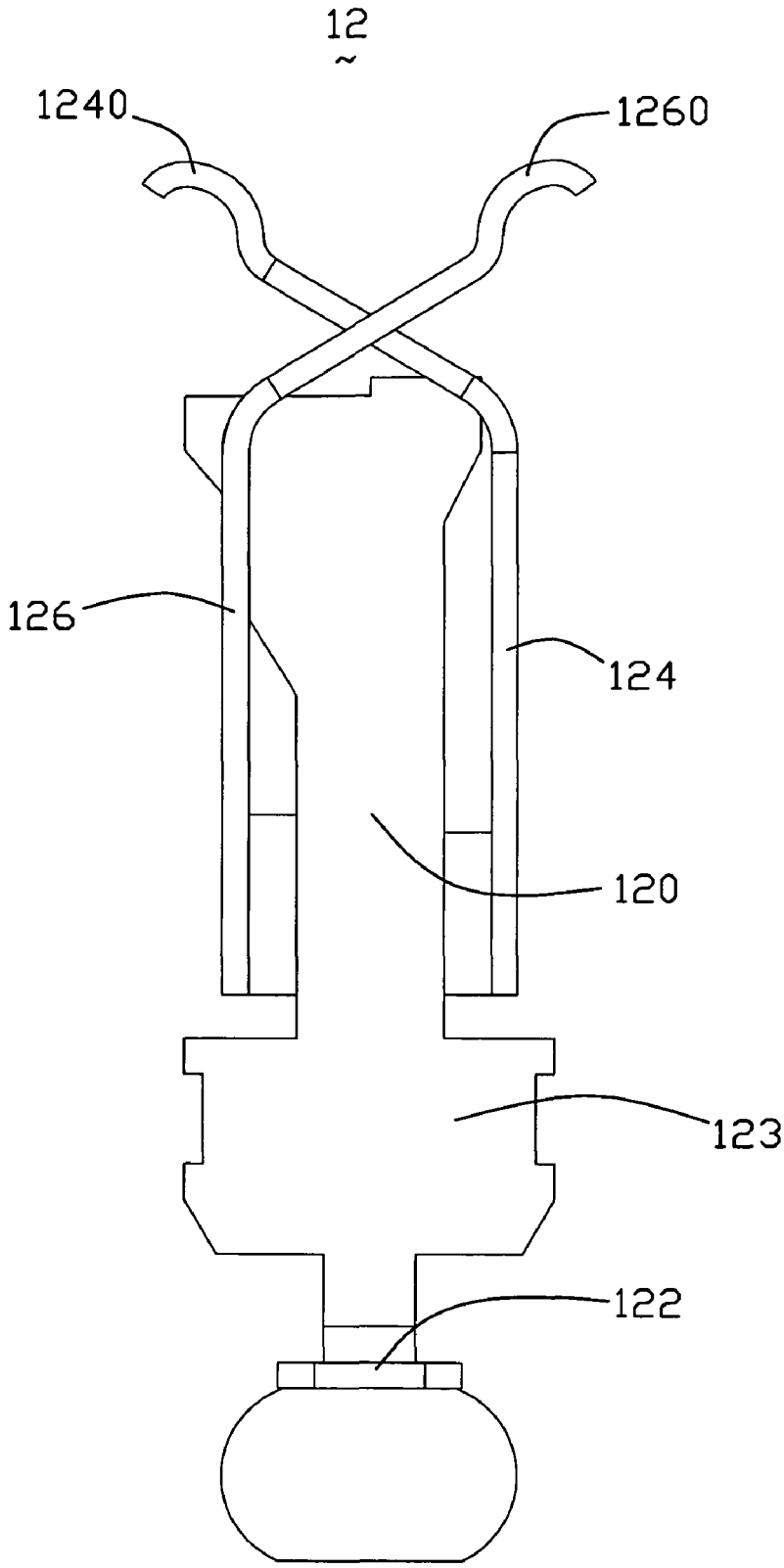
FIGS. 4-8 are a front, right side, back, top and bottom view of the contact shown in FIG. 3, respectively.
Figure 5:
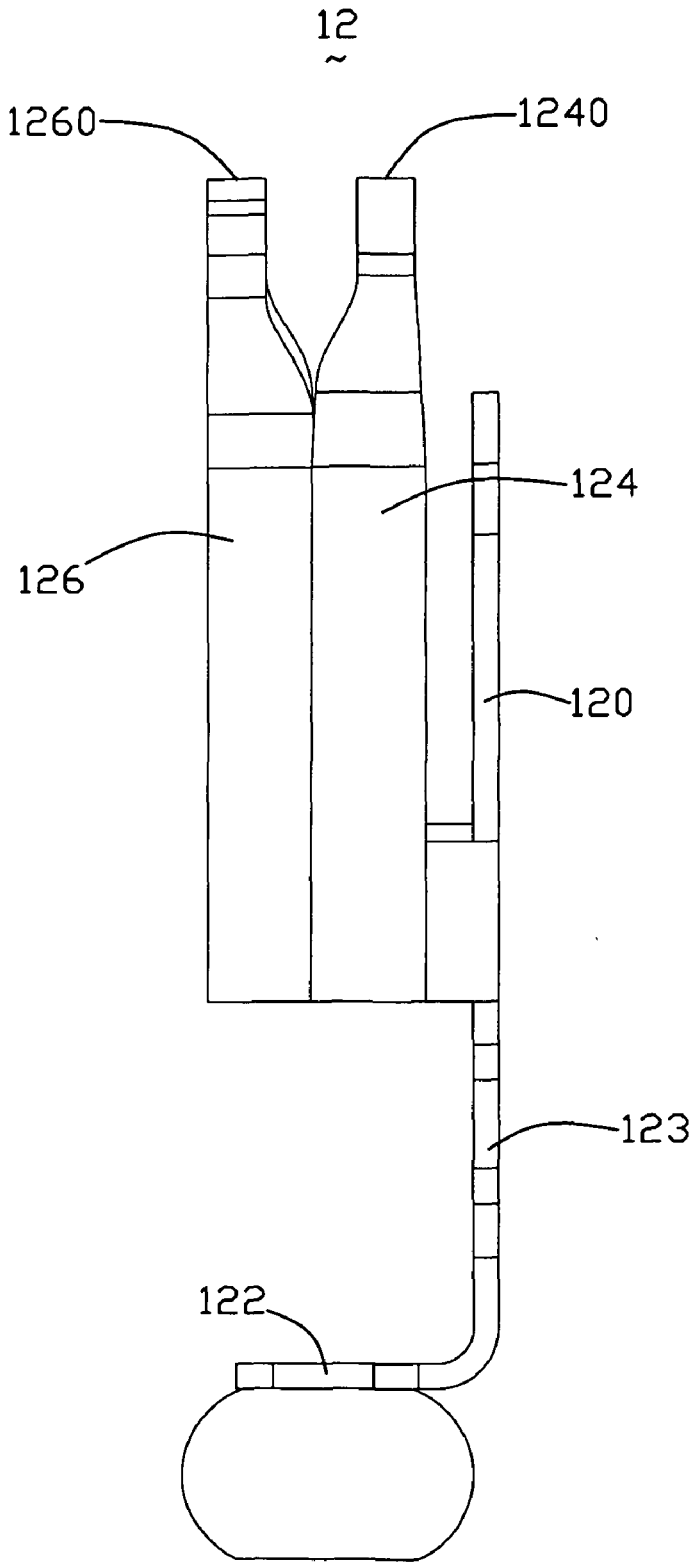
Figure 6:
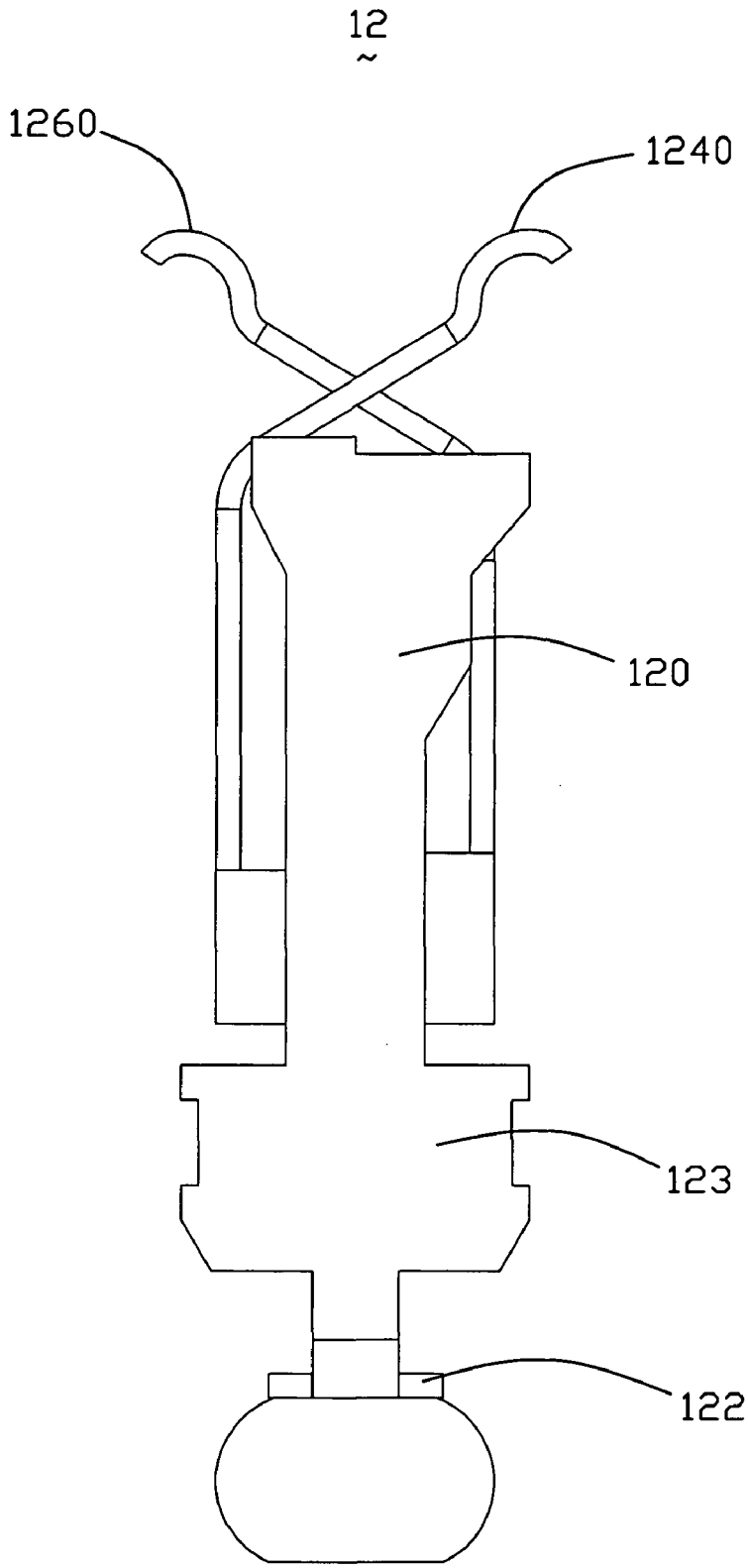
Figure 7:
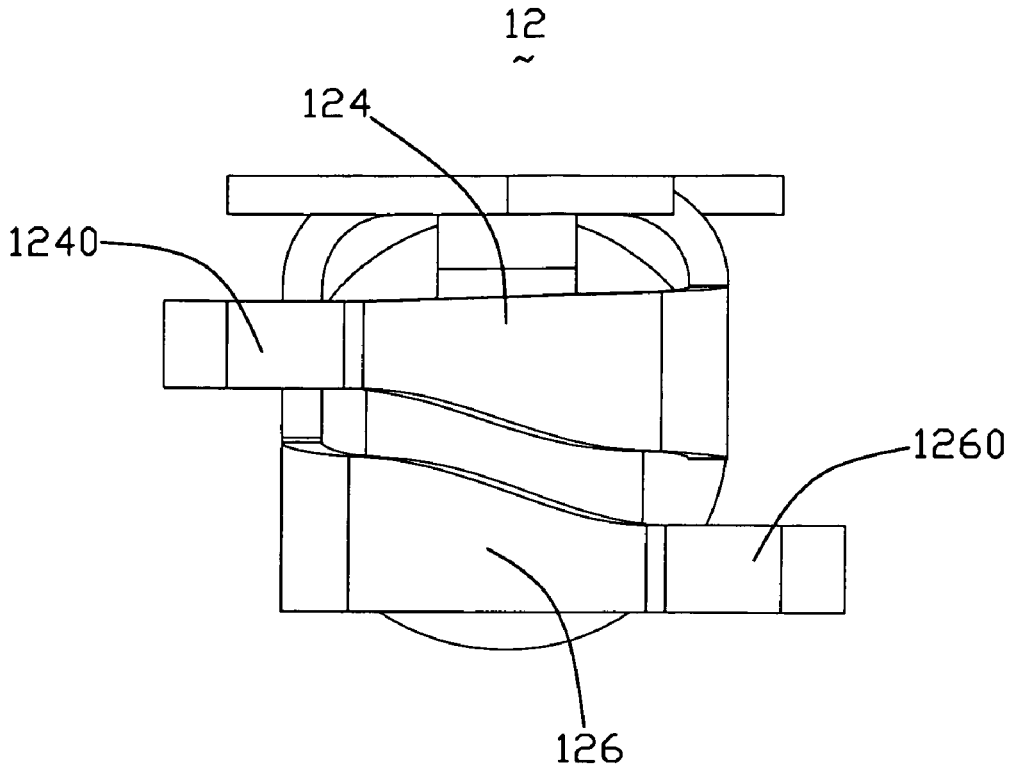
Figure 8:
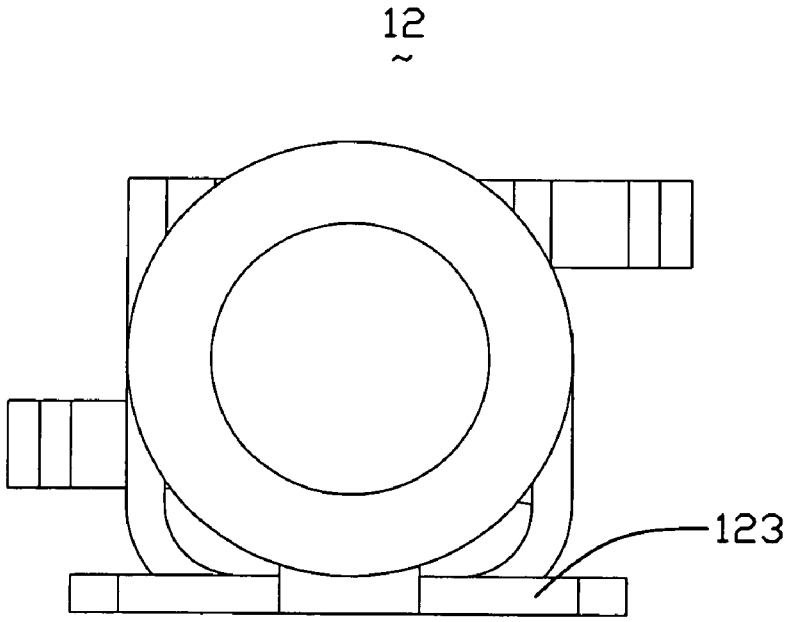
Figure 9:
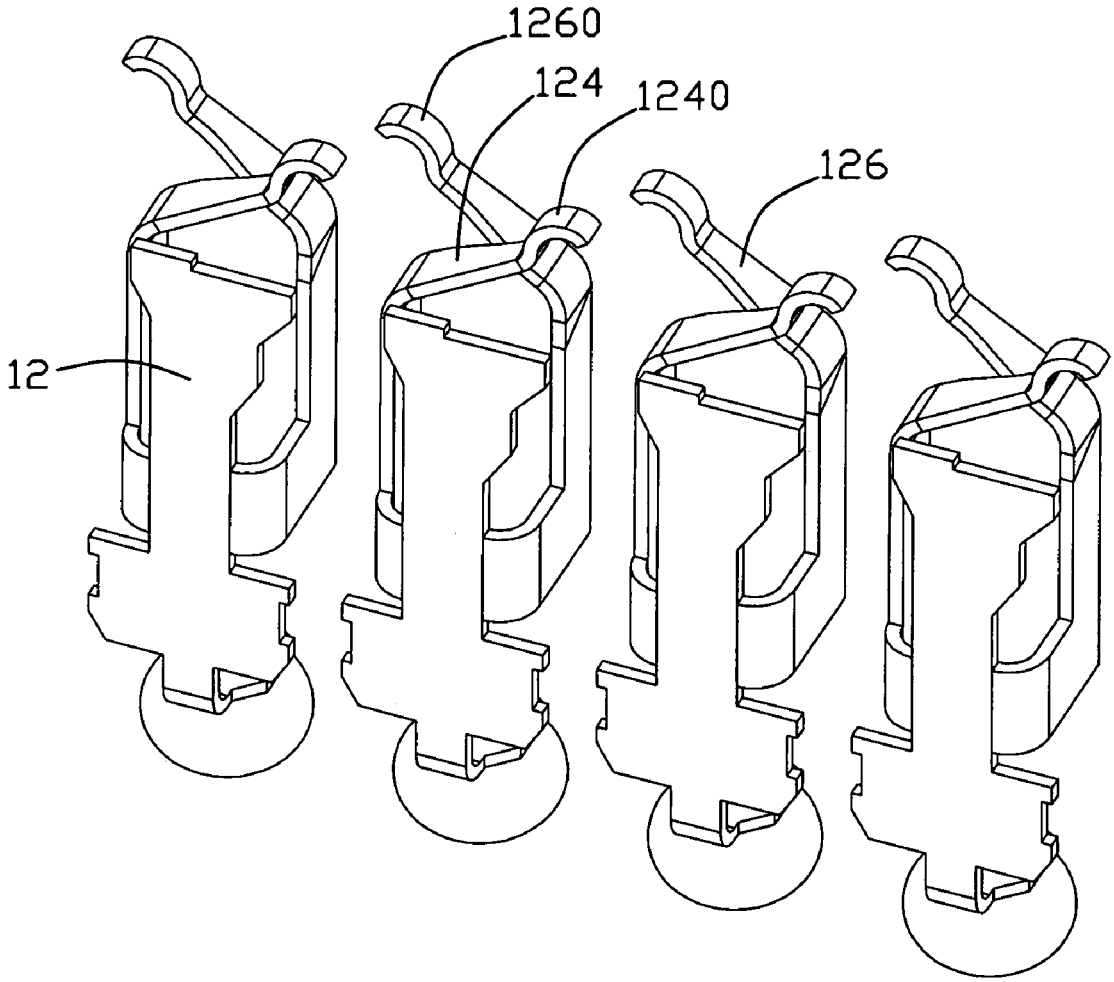
FIG. 9 is a sketch view of the contact array of the electrical connector, which shows pattern manner of one row contacts.
Figure 10:
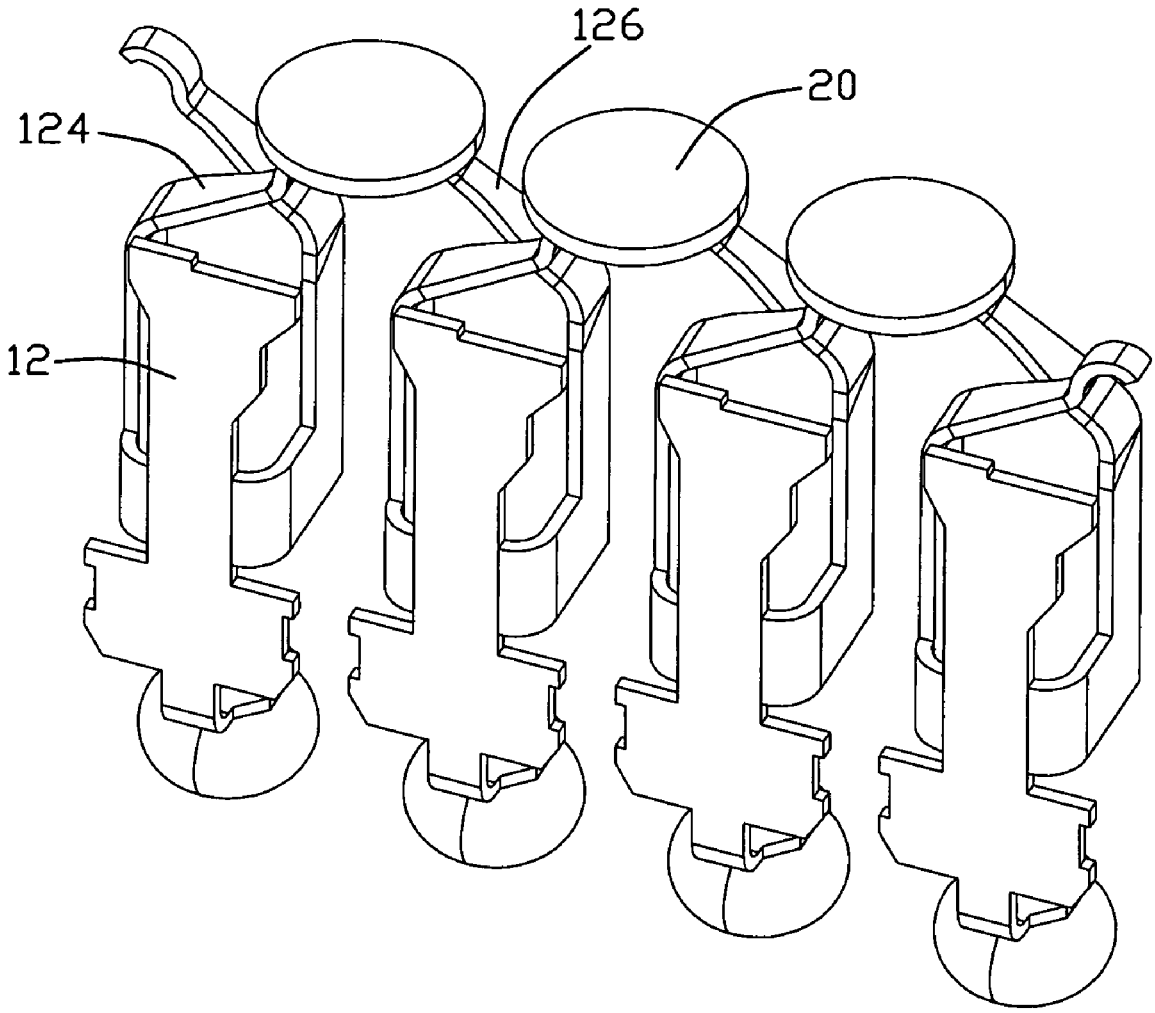
FIG. 10 is a sketch view of the contact show in FIG. 9 engaged with pads of an electronic package, which depicts two adjacent contact each having a contacting portion adjacent to each other and engaging with a same pad of the electronic package.

Referring to FIGS. 3-7, the contact 12 comprises a base portion 12 generally extending in vertical direction, a soldering portion 122 extending horizontally from a bottom end of the base portion 12, and a pair of contacting arms 124, 126 extending from opposite sides of the base portion 12. Referring to FIG. 3, the contacting arms 124, 126 of the contact 12 extend toward each other and define an intersection when they are projected onto an imaginary vertical plane. Moreover, the soldering portion 122 is located below the intersection of the two contacting arms and projects onto the vertical plane. The base portion 120 has a main plate portion 1200 and the two contacting arms 124, 126 extend toward each other from opposite sides of the main plate portion 1200 respectively and spaced from each other in the horizontal direction. The contacting arm 126 has a bigger length than that of the contacting arm 124. Ends of the contacting arms 124, 126 each have a contacting portion 1240, 1260 for connecting with a pad 20 of the electrical package 2. The contacting portion 1240, 1260 are located above a top end of the base portion 120. As depicted above, the contacting portion 1240, 1260 of the contacting arms 124, 126 also extend toward each other and spaced from each other in the horizontal direction.

Figure 11:
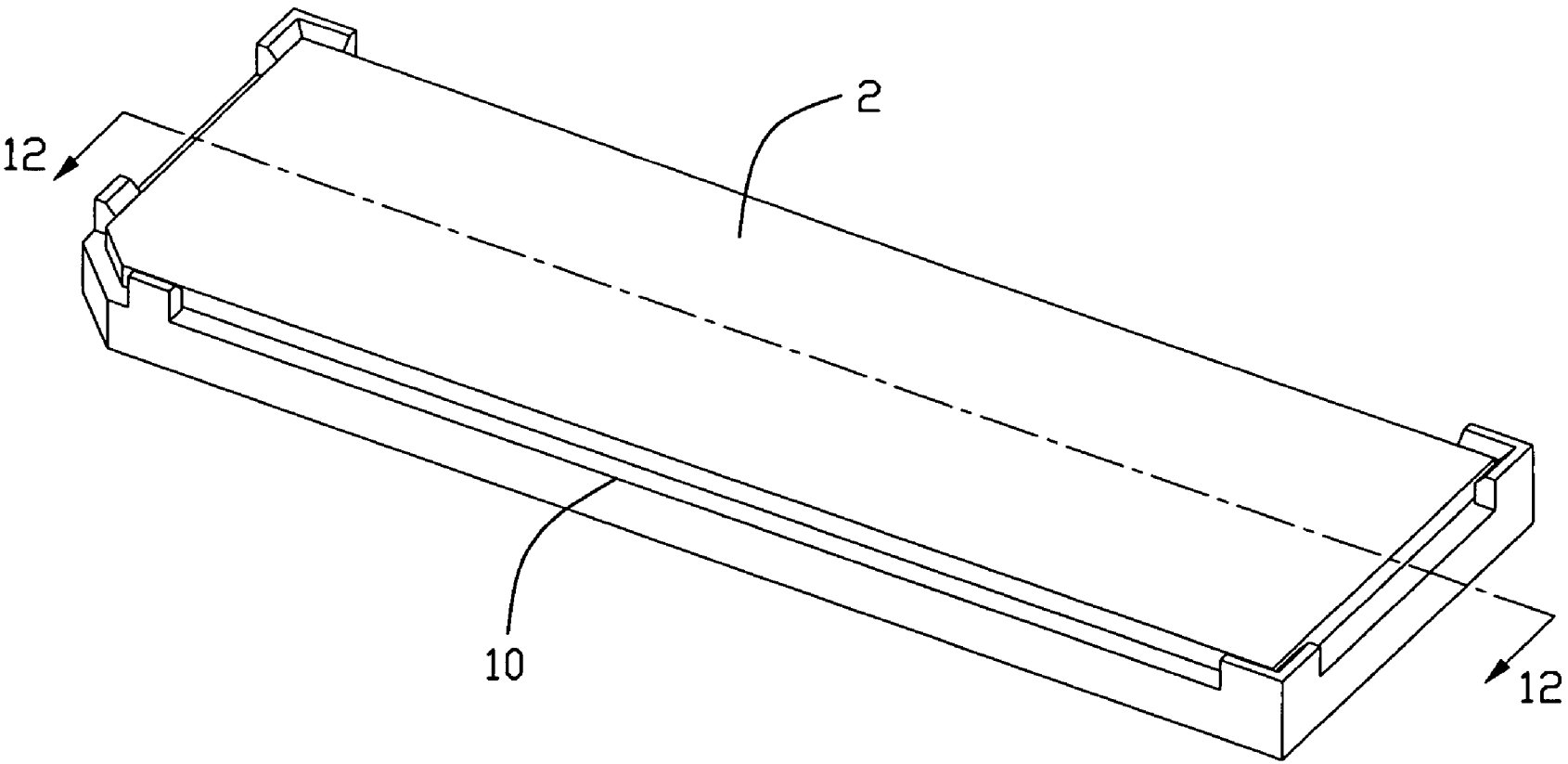
FIG. 11 is an assembly view of the electrical connector coupled with the electronic package.
Figure 12:
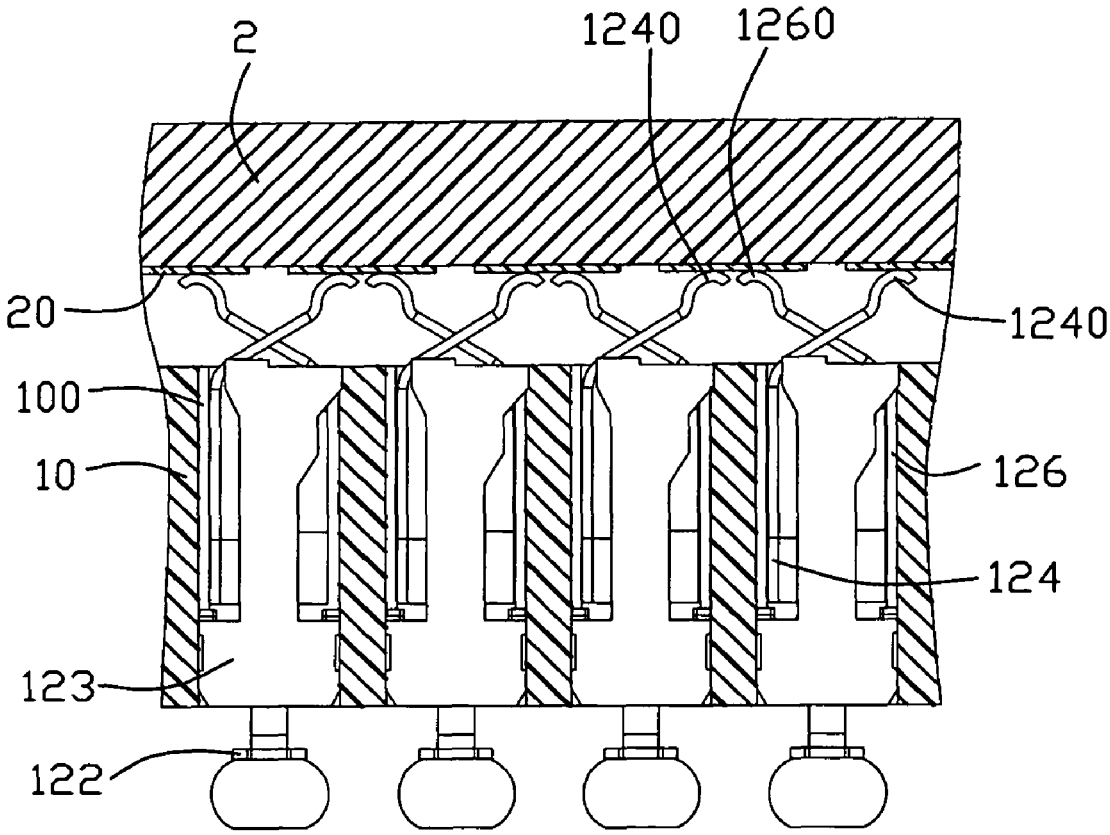
FIG. 12 is a section view taken along line 12-12 of the FIG. 11.

Referring to FIGS. 8-11, the contacts 12 are embedded in the housing 10 and distributed in rows and columns. In a random row or column, the contacting portions 1240, 1260 of two contacting arms 124, 126 of the same contact 12 are arranged adjacent to a contacting portion of an adjacent contact in the same row. Referring to FIG. 11, one contacting portion 1240 of one contact 12 is adjacent to a contacting portion 1260 of an adjacent contact 12 thereby making the contacting portion 1240 of the contact 12 and the contacting portion 1260 of the adjacent contact 12 engaging with a same pad 20 of the electrical package 2. The principle of the contacts 12 is used to form a large array pattern of group of arrays. By way above mentioned, pith between two adjacent contacts may be reduced and a high density of the contacts can be achieved and the contacts of the row are coupled with each other in series. Moreover, the prevent invention allows the electrical package 2 continued to use old design method. Further, a new idea for electrically connecting power to circuit substrate is provided.

In addition, a retaining portion 123 is disposed between the main plate portion 1200 and the soldering portion 122 for retaining the contact 12 in the housing 1. The retaining portion 123 is generally of a plate like structure and has a bigger width than the main plate portion 1200. A space (not labeled) is defined between a top end of the retaining portion 123 and a bottom end of the contacting arms 124, 126 for stamping the contact 12 easily.

While the preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting an electronic package with a circuit substrate, comprising:

an insulative housing;

a number of contacts embedded in the housing and distributed in rows and columns, each of the contact having a pair of contacting arms, each contacting arm having a contacting portion thereon for electrically connecting with a pad of the electronic package;

wherein the contacting portions of the contacts are arranged in a pattern that the contact portions of two adjacent contacts in a same row engages with a same pad on the electronic package when the electrical connector is coupled with the electronic package.

2. The electrical connector as claimed in claim 1, wherein the contact comprises a base portion generally extending in vertical direction, and the pair of contacting arms extend from opposite sides of the base portion.

3. The electrical connector as claimed in claim 2, wherein the contacting portions of two contacting arms are located above a top end of the base portion.

4. The electrical connector as claimed in claim 3, wherein the two contacting arms are spaced from each other in horizontal direction.

5. The electrical connector as claimed in claim 4, wherein the contacting arms of the contact extend toward each other and define an intersection when they are projected onto a vertical plane, the contacting portion of one contact is adjacent to the contacting portion of another adjacent contact arranged in a same row.

6. The electrical connector as claimed in claim 5, wherein the contact comprises a soldering portion extending from a bottom end of the base portion.

7. The electrical connector as claimed in claim 6, wherein the contact has a retaining portion disposed above the soldering portion.

8. The electrical connector as claimed in claim 7, wherein a top end of the retaining portion and bottom end of the contacting arms defines a space therebetween.

9. An electrical connector for electrically connecting an electronic package with a circuit substrate, comprising:

an insulative housing; and a number of contacts embedded in the housing and distributed in rows and columns, each of the contact comprising a base portion, a pair of opposite contacting arms perpendicular to the base portion and a solder portion extending downwardly from the base portion, the pair of contact arms each having a contacting portion extending to each other and beyond the opposite contact arm, one of the contacting portion being closer to the contacting portion of a neighboring contact than the other contacting portion of the same contact.

10. The electrical connector as claimed in claim 9, wherein the contacting arms of the contact define an intersection when they are projected onto a vertical plane, the contacting portion of one contact is adjacent to the contacting portion of another adjacent contact arranged in a same row.

11. The electrical connector as claimed in claim 10, wherein the contact has a retaining portion disposed above the soldering portion.

12. The electrical connector as claimed in claim 11, wherein a top end of the retaining portion and bottom end of the contacting arms defines a space therebetween.

13. An electrical connector assembly comprising:

an electronic component defining a bottom face with a plurality of conductive pads thereon in at least one row;

an insulative housing defining an upper face;

at least one row passageways defined in the housing and extending through the upper face;

a plurality of contacts disposed in the corresponding passageways, respectively, each contact defining two spring arms extending beyond the upper face and respectively mechanically and electrically engaged with the corresponding two conductive pads which are shared with the two neighboring contacts by two sides of said the contact in said row.

14. The electrical connector assembly as claimed in claim 13, wherein said two spring arms of each contact extend toward each other in a cross manner so that for every adjacent two contacts the outermost two spring arms extend toward each other and share the same conductive pad while the neighboring two spring arms extend away from each other and contact different conductive pads, respectively.

15. The electrical connector assembly as claimed in claim 13, wherein the conductive pads are respectively located between every adjacent two passageways in a top view.

16. The electrical connector assembly as claimed in claim 13, wherein said two spring arm in each contact extend from two opposite edges of a vertical plate.

17. The electrical connector assembly as claimed in claim 16, wherein said two spring arms of each contact extend toward each other in a cross manner so that one spring arm is closer to the vertical plate than the other spring arm.

* * * * *